United States Patent [19]

Takaishi et al.

[11] Patent Number: 4,951,641

[45] Date of Patent: Aug. 28, 1990

[54] IGNITION COIL ASSEMBLY STRUCTURE FOR AN INTERNAL COMBUSTION ENGINE

[75] Inventors: Tadao Takaishi; Tomokazu Umezaki, both of Himeji, Japan

[73] Assignee: Mitsubishi Denki Kabushiki Kaisha, Tokyo, Japan

[21] Appl. No.: 484,609

[22] Filed: Feb. 22, 1990

[30] Foreign Application Priority Data

Feb. 23, 1989 [JP] Japan ..... 1-41885
Feb. 23, 1989 [JP] Japan ..... 1-41886

[51] Int. Cl.[5] ..... F02P 3/04; H01F 31/00
[52] U.S. Cl. ..... 123/647; 123/634
[58] Field of Search ..... 123/634, 635, 647

[56] References Cited

U.S. PATENT DOCUMENTS

| | | | |
|---|---|---|---|
| 3,902,471 | 9/1975 | Brungsberg | 123/647 |
| 4,195,611 | 4/1980 | Wörz et al. | 132/635 |
| 4,198,943 | 4/1980 | Wörz | 123/635 |
| 4,224,971 | 9/1980 | Nakazawa et al. | 123/647 |
| 4,248,201 | 2/1981 | Tsutsui et al. | 123/634 |
| 4,392,473 | 7/1983 | Tsutsui et al. | 123/647 |
| 4,928,660 | 5/1990 | Sohner | 123/647 |

FOREIGN PATENT DOCUMENTS

| | | | |
|---|---|---|---|
| 0004939 | 1/1977 | Japan | 123/634 |
| 0202376 | 11/1983 | Japan | 123/635 |

*Primary Examiner*—Tony M. Argenbright
*Assistant Examiner*—Robert E. Mates
*Attorney, Agent, or Firm*—Sughrue, Mion, Zinn, Macpeak and Seas

[57] ABSTRACT

A housing structure of an ignition coil assembly for an internal combustion engine is disclosed, in which the coil assembly and the igniter are accommodated in a single casing. The coil assembly is wound around a leg of a rectangular core having a yoke portion running parallel to it. The casing accommodates the coil assembly and the leg of the core carrying it, leaving exposed to the outside the yoke of the core; a space is formed between a side of the coil assembly and a side wall of the casing. A plate-shaped heat sink abutting on the yoke of the core at its lower end extneds witin the casing between the coil assembly and the casing through said space, forming within the space a hollow receptacle between opposing surfaces of the coil assembly and the casing. The igniter is mounted to the heat sink within the hollow receptacle. The housing structure is attached to the body of an automobile, etc., at a surface of the heat sink abutting on the yoke of the core.

6 Claims, 2 Drawing Sheets

IGNITION COIL ASSEMBLY STRUCTURE FOR AN INTERNAL COMBUSTION ENGINE

BACKGROUND OF THE INVENTION

This invention relates to housing structures of ignition coil assemblies for internal combustion engines, which comprise, in addition to an ignition coil, an igniter circuit for controlling the primary current supplied to the ignition coil.

Conventional ignition systems for internal combustion engines of automotive vehicles generally comprise breaker points for interrupting the primary current in the ignition coil, in synchrony with the rotation of the engine. Recently, however, ignition systems have been developed which utilize semiconductor circuits (i.e., igniters) instead of the breaker points. FIG. 1 shows, in a circuit diagram, the portion of such an ignition system including the ignition coil 1 and the igniter 2, wherein the igniter 2 constitutes the control circuit for controlling the current supplied to the primary coil winding 1*a* of the ignition coil 1. In the case of conventional housing structures of these igniter or semiconductor type ignition systems for an engine of an automotive vehicle, the ignition coil 1 and the igniter 2 are accomodated in respective separate casings, wherein the casing accomodating the igniter 2 is mounted to the casing accomodating the ignition coil 1, or alternatively, the casing of the igniter 2 is accommodated within the distributor of the ignition system.

The above conventional housing structure of the ignition coil assembly of the igniter type ignition systems has the following disadvantage: The provision of separate casings for the ignition coil and the igniter increases the dimensions and production costs of the ignition coil assemblies.

SUMMARY OF THE INVENTION

It is therefore a primary object of this invention to provide an ignition coil assembly structure for an internal combustion engine which is small in size, easy to assemble, and low in cost.

The above object is accomplished in accordance with the principle of this invention in an ignition coil assembly structure in which the coil assembly of the ignition coil and the control circuit for controlling the primary current in the ignition coil are accomodated in a single casing:

The coil assembly including the primary and the secondary coil windings of the ignition coil is wound around a leg of a rectangular core, which comprises a yoke portion that runs parallel to the leg portion thereof but carries no coil windings of the ignition coil. The casing accomodates the coil assembly and the leg portion of the yoke carrying it, leaving exposed to the outside at least a portion of the yoke portion of the rectangular core; a space is formed between an outer side surface of the coil assembly and a side wall of the casing. Further, the ignition coil assembly structure according to this invention comprises a plate-shaped heat sink of a good heat conducting material abutting on the yoke portion of the core at an end portion thereof; the heat sink extends within the casing between the coil assembly and the casing, through the space formed between a side surface of the coil assembly and a side wall of the casing, thereby forming within said space a hollow receptacle between the opposing surfaces of the casing and the heat sink. The control circuit for controlling the primary current in the coil assembly is mounted on the heat sink within the hollow receptacle. The ignition coil assembly structure is attached to an appropriate attachment portion of the automotive vehicle carrying the internal combustion engine or of the internal combustion engine itself.

In a preferred form, the ignition coil assembly structure further comprises the following: a fixing means, such as a fixing screw, for fixing the control circuit to the heat sink, extending through a hole formed in the side wall of the casing partitioning the hollow receptacle; an amount of resin material filling the hollow receptacle; and a label attached to a side surface of the casing so as to close the hole formed in the side wall of the casing. Further, it is preferred that the casing has windows formed in side walls thereof such that portions of the heat sink are exposed to the outside of the casing, so as to facilitate the radiation of heat from the heat sink. It is also preferred that the casing is divided into two portions: a cup-shaped main portion enclosing the coil assembly and the leg portion of the core and opening in an axial direction of the coil assembly; and a lid portion closing the opening of the main portion and carrying electrical terminals for the coil assembly and the control circuit.

The novel features which are believed to be characteristic of this invention are set forth with particularity in the appended claims. This invention itself, however, both as to its structure and method of assembling it, together with further objects and advantages thereof, may best be understood from the following detailed description of the preferred embodiment in connection with the accompanying drawing.

BRIEF DESCRIPTION OF THE DRAWINGS

In the drawings, like reference numerals represent like or corresponding parts.

DETAILED DESCRIPTION OF THE PREFERRED EMBODIMENT

Figure 1:
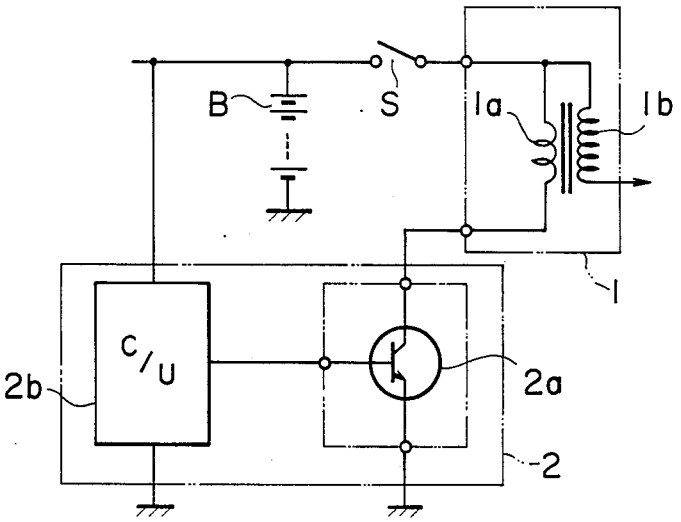
FIG. 1 is a circuit diagram showing the electrical circuit organization of an ignition coil assembly including an igniter.
Figure 2:
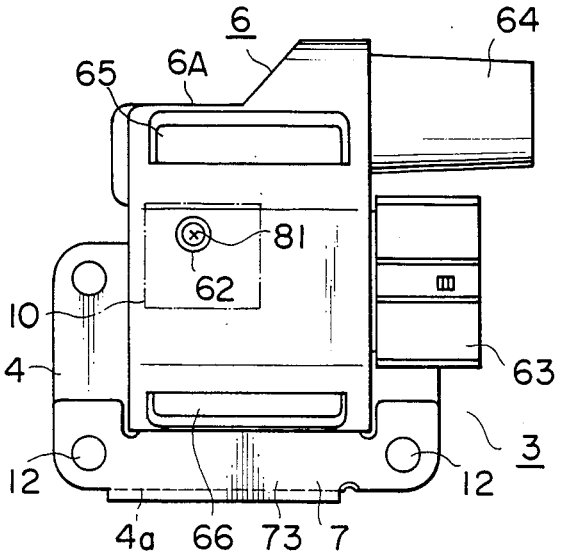
FIGS. 2 and 3 are a side and a front view of the ignition coil assembly structure according to this invention.
Figure 3:
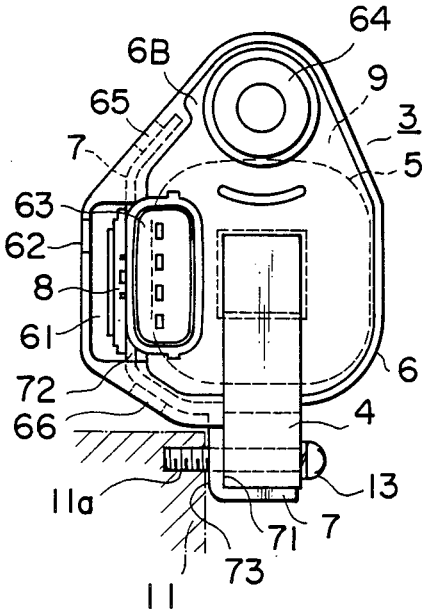

Referring now to FIGS. 1 through 3 of the drawings, an embodiment of this invention is described.

The electrical circuit organization of the ignition coil assembly structure according to the embodiment of this invention is similar to that of the above-mentioned conventional igniter type ignition coil assembly; thus, as shown in FIG. 1, the electrical circuit of the ignition coil assembly structure of the embodiment comprises: an ignition coil 1 having a primary coil winding 1*a* and a secondary coil winding 1*b;* and an igniter circuit 2, including a power transistor 2*a* and a control unit 2*b*, for controlling the on-off operations of the power transistor 2*a*. The power transistor 2*a* is turned on and off in response to the control signal from the control unit 2*b*. Each time the power transistor is turned off, the primary current, supplied from the battery B via the ignition siwtch S and flowing through the primary coil 1*a* and the power transistor 2*a*, is interrupted, and a high ignition voltage is thus induced across the secondary coil 1*b* of the ignition coil 1, which ignition voltage is supplied therefrom to a spark plug of an internal combustion engine (not shown) via a distributor (not shown).

FIGS. 2 and 3 show the housing structure of the ignition coil assembly whose circuit diagram is shown in FIG. 1; FIG. 2 is a side view of the ignition coil assembly structure as viewed from left in FIG. 3, and FIG. 3 is a front view thereof as viewed from right in FIG. 2. Let us first describe the construction of the ignition coil assembly structure in the assembled state, which structure is generally designated by reference numeral 3 in FIGS. 2 and 3:

The bulk of the ignition coil assembly structure 3 is occupied by a rectangular core 4 of a laminated soft magnetic material and a coil assembly 5 wound around a leg of the core 4, which together constitute the ignition coil 1 of the circuit shown in FIG. 1. The rectangular core 4 comprises a yoke portion 4*a* (which serves to complete the magnetic circuit of the ignition coil but carries no coil windings therearound) running parallel to the leg carrying the coil assembly 5; the coil assembly 5 comprises a primary and a secondary coil 1*a* and 1*b* shown in FIG. 1. The coil assembly 5 and the leg of the core 4 carrying the coil assembly 5 are accomodated within a casing 6, which leaves exposed to the outside thereof at least a portion of the yoke portion 4*a* of the core 4. (In the case of this embodiment the entire yoke portion 4*a* is outside of the casing 6 and hence is exposed to the outside.) The casing 6, made for example of a synthetic resin, is devided into two portions: a substantially cup-shaped main portion 6A opening in an axial direction of the coil assembly 5 (toward right in FIG. 2) and having rectangular heat-radiation windows (or openings) 65 and 66 through which a portion of the heat sink 7 is exposed; and a lid plate 6B carrying a high voltage secondary terminal 64 (coupled to the secondary coil winding 1*b* of FIG. 1) and an electrical connector 63 including a plurality of terminals for the control circuit 8 (which comprises the igniter 2 of the circuit shown in FIG. 1). Between a side wall (at the left in FIG. 3) of the casing 6 and the opposing side surface of the coil assembly 5 is formed a rectangular space, constituting a hollow receptacle or pocket portion 61 for accomodating the control circuit 8, as described below. A plate-shaped heat sink 7, which abut on the yoke portion 4*a* of the core 4 at an L-shaped lower end portion (see FIG. 3) and side extensions thereof having holes 12 formed in registry with the holes 12 extending through the core 4 (see FIG. 2), extends through the above-mentioned rectangular space along the side surface of the coil assembly 5, so as to form within the space the hollow receptacle or pocket portion 61 between the opposing surfaces of the heat sink 7 and the side walls of the casing 6; the portion of the heat sink 7 within the pocket portion 61 constitutes an attachment portion 72 for the control circuit 8 corresponding to the igniter 2 of the circuit of FIG. 1. Further, portions of the heat sink 7 at the windows 65 and 66 formed in the casing 6 are directly exposed to the outside air for facilitating radiation of heat therefrom. The heat sink 7 is formed by a press from a plate of a good heat conducting material such as aluminum, copper, or an alloy thereof. The control circuit 8, including a power transistor 2*a* for controlling the primary current in the coil assembly 5 is mounted to the attachment portion 72 of the heat sink 7 by means, for example, of a fixing screw 81 extending through a hole 62 formed in the side wall of the main portion 6A of the casing 6. The space 9 formed within the casing 6 above the coil assembly 5 is filled with an epoxy resin, while the pocket portion 61 is filled with a silicone gel. The hole 62 is closed by a label 10 identifying the type, the name of the producer, and the lot number of the ignition coil assembly structure.

As shown in FIG. 3, the ignition coil assembly structure 3 is mounted to an attachment portion 11 formed at an appropriate portion of the automotive vehicle carrying the internal combustion engine or at a portion of the internal combustion engine itself. Namely, the bolts 13 extending through the attachment-holes 12 formed through the core 4 and the heat sink 7 are screwed into threaded holes 11*a* formed in the attachment portion 11, so as to mount the ignition coil assembly structure 3 to the attachment portion 11 at the attachment surface 73 of the heat sink 7 opposite to a surface 71 thereof abutting on the yoke portion 4*a* of the core 4.

Next, let us describe the method of assembling the ignition coil assembly structure 3 of FIGS. 2 and 3.

Before assembled, the rectangular core 4 is capable of being disassembled into a pair of U-shaped halves (with the legs of the two U's extending in the opposite horizontal directions in FIG. 2). Thus, the substantially cup-shaped main portion 6A of the casing 6 is molded integrally with one of the U-shaped half of the core 4 having the legs of U extending toward right in FIG. 2, together with the heat sink 7, whose L-shaped end is kept pressed against the yoke portion 4*a* of the core 4 during the molding process. The lid 6B may be molded integrally with the coil assembly 5, or as a separate piece apart therefrom. The molded cup-shaped main portion 6A opens toward the right in FIG. 2; thus, the coil assembly 5 and the control circuit 8 are fitted into respective positions within the main portion 6A of the casing 6, and the control circuit 8 is fixed by a fixing screw 81 extending through the hole 62 in the casing 6, the hole 62 being closed by a label 10. After the electrical connections are made among the coil assembly 5 and the control circuit 8 within the main portion 6A of the casing 6, and the connector 63 and the high voltage secondary terminal 64 on the lid 6B of the casing 6, the space 9 and the pocket portion 61 are filled with an epoxy resin and a silicone gel, respectively. Thereafter, the lid 6B is fitted onto the opening of the main portion 6A of the casing 6, and the remaining U-shaped half of the core 4 is fixed to the half of the core 4 molded with the main portion 6A of the casing 6. This completes the assembling operation of the ignition coil assembly structure 3; the assembled structure 3 is attached to the attachment portion 11 as described above.

The method of operation of the ignition coil assembly structure of FIGS. 1 through 3 is as follows. As is well known to those skilled in the art, the control unit 2*b* of the igniter 2 shown in FIG. 1 (which igniter 2 is comprised by the control circuit 8 of FIG. 3) receives from a signal generator (not shown) disposed within the distributor (not shown) a pulse-shaped signal corresponding to the rotational angle of the crankshaft of the internal combustion engine; the control unit 2*b* of the circuit of FIG. 1 controls the on-off of the power transistor 2*a* in accordance with this signal indicating the rotational position of the crankshaft. Each time the power transistor 2*a* is turned off to interrupt the current flowing through the primary coil winding 1*a* of the ignition coil 1, a pulse-shaped high voltage is induced across the secondary coil winding 1*b*. The coil assembly 5 shown in FIG. 3 comprises the primary and the secondary coils 1*a* and 1*b* of FIG. 1. Thus, the high voltage induced in the coil assembly 5 is supplied via the secondary terminal 64 to the distributor (not shown) through a high tension cord (not shown) electrically coupled to the secondary terminal 64. The heat generated in the power transistor in the control circuit 8 during these operations, and that generated in the coil assembly 5, etc., are transmitted to the heat sink 7, from which a portion of the received heat is radiated to the outside air via the windows 65 and 66 of the casing 6, and a portion thereof is transmitted to the attachment portion 11 via the attachment surface 73 of the heat sink 7. Further, a portion of the heat generated in the control circuit 8 is transmitted effectively to the casing 6 via the resin material (i.e., silicone gel) filling the pocket portion 61, to be radiated from the outside surface of the casing 6.

The advantage resulting from the housing structure of the ignition coil assembly according to the embodiment of this invention is as follows. Since the control circuit 8 and the coil assembly 5 are accomodated within a single casing 6, the ignition coil assembly structure can be reduced in size. Further, the main portion 6A of the casing 6 is molded integrally with a half portion of the core 4 together with the heat sink 7, and in addition, the control circuit 8 is accomodated within a pocket portion 61 formed within the casing 6, wherein the hole 62 for letting through the fixing screw 81 for fixing the control circuit 8 to the heat sink 7 is closed by the simple means of a label 10; thus, the assembling procedure of the ignition coil assembly structure is simple and can be effected easily and speedily without loss of time and labor.

While description has been made above of the particular embodiment of this invention, it will be understood that many modifications may be made without departing from the spirit thereof. For example, although the casing 6 is devided into the cup-shaped main portion 6A and the lid portion 6B in the case of the above embodiment, this invention is not limited to that particular type of the casing. Similarly, this invention is not limited to the particular type of core 4 which can be disassembled into two U-shaped halves, nor to the particular type of circuit structure (shown in FIG. 1) of the control circuit 8. Further, the heat-radiation windows 65 and 66 may be dispensed with. The appended claims are contemplated to cover any such modifications as fall within the true spirit and scope of this invention.

What is claimed is:

1. An ignition coil assembly structure for an internal combustion engine, adapted to be attached to an attachment portion of a structure including the internal combustion engine, said ignition coil assembly comprising:

a rectangular core having a leg portion and a yoke portion running parallel to said leg portion;

a coil assembly wound around said leg portion of the rectangular core, said coil assembly including a primary and a secondary coil for generating a high ignition voltage;

a casing accommodating therein the coil assembly and said leg portion of the core, leaving exposed to an outside of the casing at least a portion of said yoke portion of the core, and forming therewithin a space between an outer side surface of the coil assembly and a side wall of the casing;

a plate-shaped heat sink of a good heat-conducting material abutting on said yoke portion of the core at an end portion thereof, said heat sink extending within the casing between the coil assembly and the casing through said space, to form within said space a hollow receptacle between opposing surfaces of the casing and the heat sink, the ignition coil assembly structure being adapted to be attached to said attachment portion at a surface of the heat sink opposite to a surface abutting on said yoke portion of the core; and a control circuit portion controlling the primary current flowing through the primary coil of said coil assembly, the control circuit portion being disposed on said heat sink within said hollow receptacle.

2. An ignition coil assembly structure as claimed in claim 1, further comprising:

fixing means for fixing said control circuit portion to the heat sink, extending through a hole formed in a portion of the side wall of the casing partitioning said hollow receptacle;

an amount of resin material filling said hollow receptacle; and a label attached to a side surface of the casing so as to close said hole formed in the side wall of the casing.

3. An ignition coil assembly structure as claimed in claim 1, wherein the casing has windows formed in the side wall thereof such that portions of the heat sink are exposed to an outside of the casing via the windows.

4. An ignition coil assembly structure as claimed in claim 2, wherein the casing has windows formed in the side wall thereof such that portions of the heat sink are exposed to an outside of the casing via the windows.

5. An ignition coil assembly structure as claimed in claim 1, wherein said casing comprises: a cup-shaped main portion enclosing the coil assembly and the leg portion of the core and having an opening directed in an axial direction of the coil assembly; and a lid portion closing said opening of the main portion and carrying electrical terminal means for providing electrical terminals for said coil assembly and said control circuit portion.

6. An ignition coil assembly structure as claimed in claim 2, wherein said casing comprises: a cup-shaped main portion enclosing the coil assembly and the leg portion of the core and having an opening directed in an axial direction of the coil assembly; and a lid portion closing said opening of the main portion and carrying electrical terminal means for providing electrical terminals for said coil assembly and said control circuit portion.

* * * * *